US008167743B1

(12) United States Patent
Kangas et al.

(10) Patent No.: US 8,167,743 B1
(45) Date of Patent: May 1, 2012

(54) FOOTBALL TRAINING SYSTEM

(75) Inventors: Elston Howard Kangas, Ottertail, MN (US); Lloyd Earl Danzeisen, Fergus Falls, MN (US)

(73) Assignee: DanKa, LLC, Fergus Falls, MN (US)

( * ) Notice: Subject to any disclaimer, the term of this patent is extended or adjusted under 35 U.S.C. 154(b) by 0 days.

(21) Appl. No.: 12/797,985

(22) Filed: Jun. 10, 2010

Related U.S. Application Data

(60) Provisional application No. 61/185,791, filed on Jun. 10, 2009.

(51) Int. Cl.
*A63B 69/00* (2006.01)

(52) U.S. Cl. ..... 473/441; 437/422

(58) Field of Classification Search ..... 473/422, 473/438, 439, 441, 442, 443, 444, 445; 482/83–90
See application file for complete search history.

(56) References Cited

U.S. PATENT DOCUMENTS 547,731 A * 10/1895 Maclearn ..... 482/85
1,287,176 A * 12/1918 Armstrong ..... 73/379.05
1,663,659 A * 3/1928 Hart et al. ..... 473/444
1,884,816 A * 10/1932 Oakes ..... 473/444
1,995,495 A * 3/1935 Barnick ..... 482/86
2,909,370 A * 10/1959 Fortney ..... 482/83
2,913,245 A * 11/1959 Landis ..... 473/444
3,022,072 A * 2/1962 Zinnow ..... 482/90
3,252,242 A * 5/1966 Zalkind ..... 446/325
3,825,260 A * 7/1974 Thomas, Sr. ..... 473/444
4,903,966 A * 2/1990 Liao ..... 473/423
5,330,403 A * 7/1994 Kuo ..... 482/83
5,415,552 A 5/1995 Harmon et al.
5,437,590 A * 8/1995 D'Alto ..... 482/90
5,624,358 A * 4/1997 Hestilow ..... 482/90
5,674,157 A * 10/1997 Wilkinson ..... 482/83
5,921,895 A * 7/1999 Lynch et al. ..... 482/83
6,027,435 A * 2/2000 Nadorf et al. ..... 482/146
6,077,204 A * 6/2000 Dickinson, Jr. ..... 482/83
6,390,958 B1 * 5/2002 Chu ..... 482/90
6,398,697 B1 * 6/2002 Nichols, Jr. ..... 482/87
6,464,621 B1 * 10/2002 Chen ..... 482/83
6,786,854 B1 * 9/2004 Hsu ..... 482/83
RE39,372 E * 11/2006 Kuo ..... D21/787
7,131,917 B2 * 11/2006 Spencer ..... 473/444
7,147,579 B2 * 12/2006 Forrest ..... 473/441
7,357,760 B1 * 4/2008 Rios ..... 482/90
2004/0209743 A1 * 10/2004 Perez ..... 482/83
2007/0099730 A1 * 5/2007 Driver ..... 473/422
2010/0311524 A1 * 12/2010 Lay ..... 473/417

* cited by examiner

*Primary Examiner* — Mitra Aryanpour
(74) *Attorney, Agent, or Firm* — Dicke, Billig & Czaja, PLLC

(57) ABSTRACT

A football training system which allows for the quick and easy movement of the target unit, i.e., a blocking dummy. The training system comprises one or more combinations of a base, a flexible support member mountable at one of three locations on the base, and a padded target mounted on the flexible support member.

15 Claims, 8 Drawing Sheets

FOOTBALL TRAINING SYSTEM

CROSS-REFERENCE TO RELATED APPLICATION

This application claims the benefit of U.S. provisional application No. 61/185,791 filed Jun. 10, 2009.

TECHNICAL FIELD

This application concerns equipment used in training for football and related sports.

BACKGROUND

Blocking dummies are used in the instruction and practice of football. An example is shown in U.S. Pat. No. 5,415,552 issued May 16, 1995.

SUMMARY

This application describes a system for training for sports such as American football. The training system provides quick and easy movement of a target unit, i.e., a blocking dummy. More specifically, the training system provides an adaptable, structured arrangement of game-related formations for the on-field instruction and training of players.

In one embodiment, the system comprises the combination of: an elongated flexible support capable of bending substantially ninety degrees in any direction about a flexion point located adjacent a lower end of the flexible support; a padded target attached lengthwise over an upper end of the elongated flexible support; and a base comprising at least three vertically-opening receptacles. The padded target may be cylindrical or rectangular. Each receptacle holds the elongated flexible support above the base, yet allows for rapid repositioning of the flexible support to another of the three receptacles. Each of the three receptacles is typically located at one of left, center, and right positions relative to a centerline of the base.

Optionally, the base further comprises a handle; or has eight edges forming an irregular octagon; or is formed substantially entirely from a resilient material, although it is preferred that the base comprise an inner material (typically metal) externally covered with a resilient material.

Other options include: the elongated flexible support being a pair of substantially identical support shafts arranged parallel to each other. Then, if each of the three receptacles of the base is a pair of substantially identical receptacles, the base will provide a total of six receptacles, each receptacle holding one support shaft of the double-shafted support. A further option is to space receptacles so that a total of five distinct pairs of immediately adjacent receptacles may be used from among the six total receptacles. Yet another option is for a seventh receptacle, centered between the centermost pair of immediately adjacent receptacles.

BRIEF DESCRIPTION OF THE FIGURES

The accompanying figures show a particular preferred embodiment as an example, but such illustration is not intended to limit the scope of the claims. In particular, the proportions and/or dimensions that may be shown in, or suggested by, the figures are preferred but not required except as specifically set forth in the claims.

DETAILED DESCRIPTION

The following description necessarily relies on a particular preferred embodiment only as an example. Accordingly, specific reference to structures for performing a function should also be understood as being intended to disclose performance of the function per se by the same or equivalent structures. The full scope of such functions is defined by claims to methods that appear at the conclusion of this application.

Components

Figure 1:
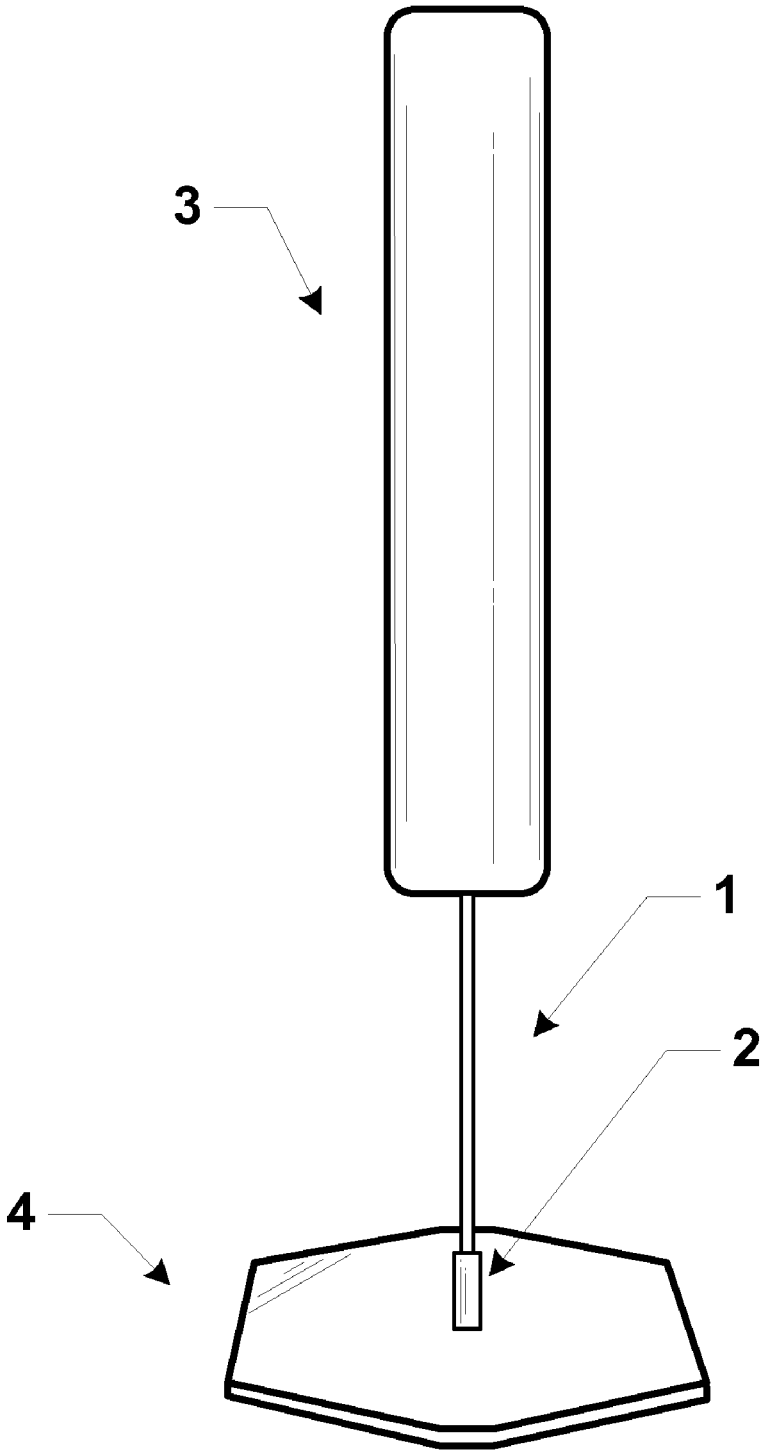
FIG. 1 is a front view of one embodiment of a training system.
Figure 2:
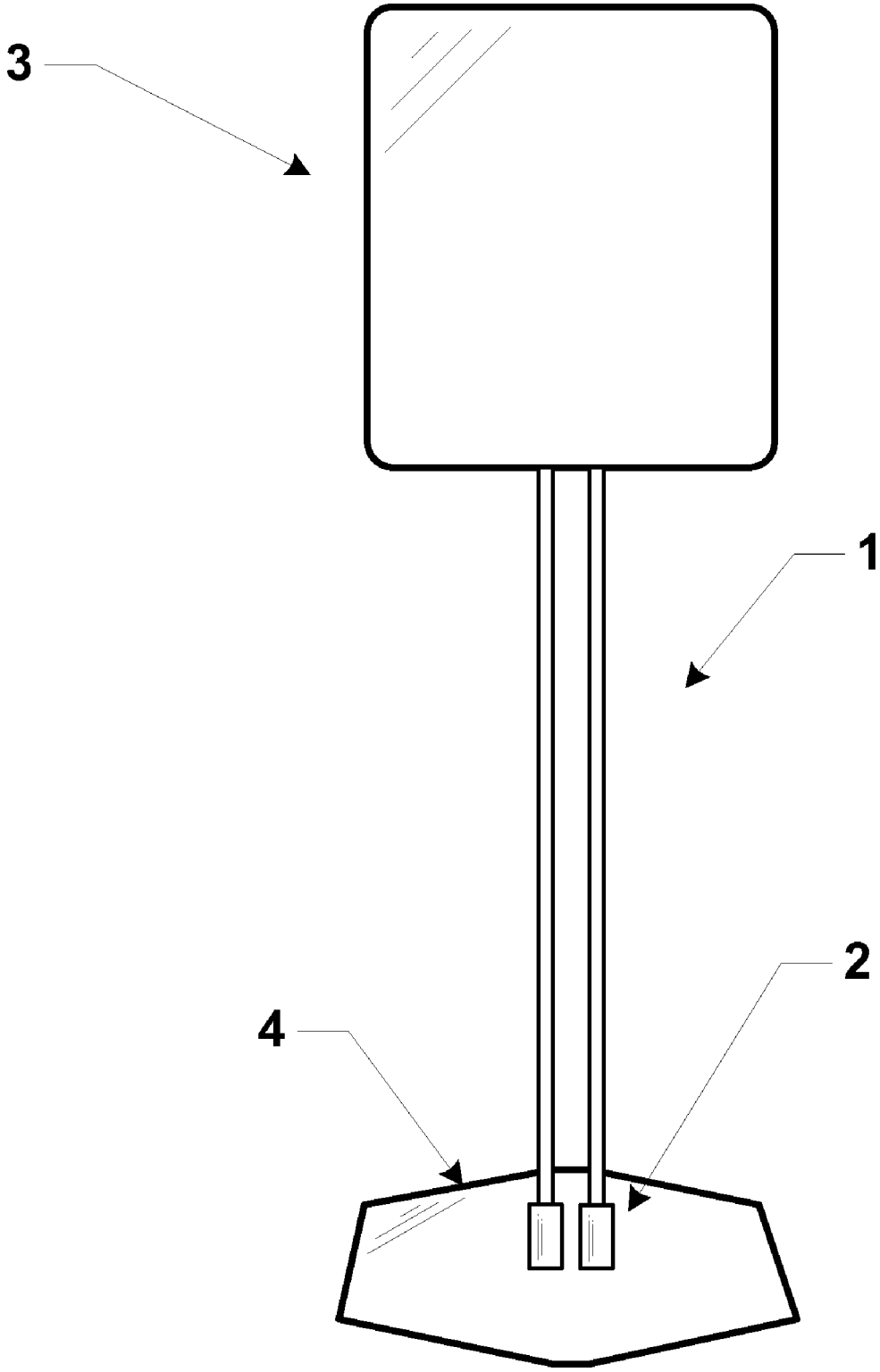
FIG. 2 is a front view of an alternative embodiment of a training system.

As illustrated in FIGS. 1-2, the football training system is a combination of two main components. The first component, a target unit, comprises an elongated flexible support 1 capable of bending substantially ninety degrees in any direction about a flexion point generally indicated as 2 (see also FIGS. 4 and 5; note the curved arrow in FIG. 4). The flexion point is located adjacent a lower end of the flexible support.

Figure 3:
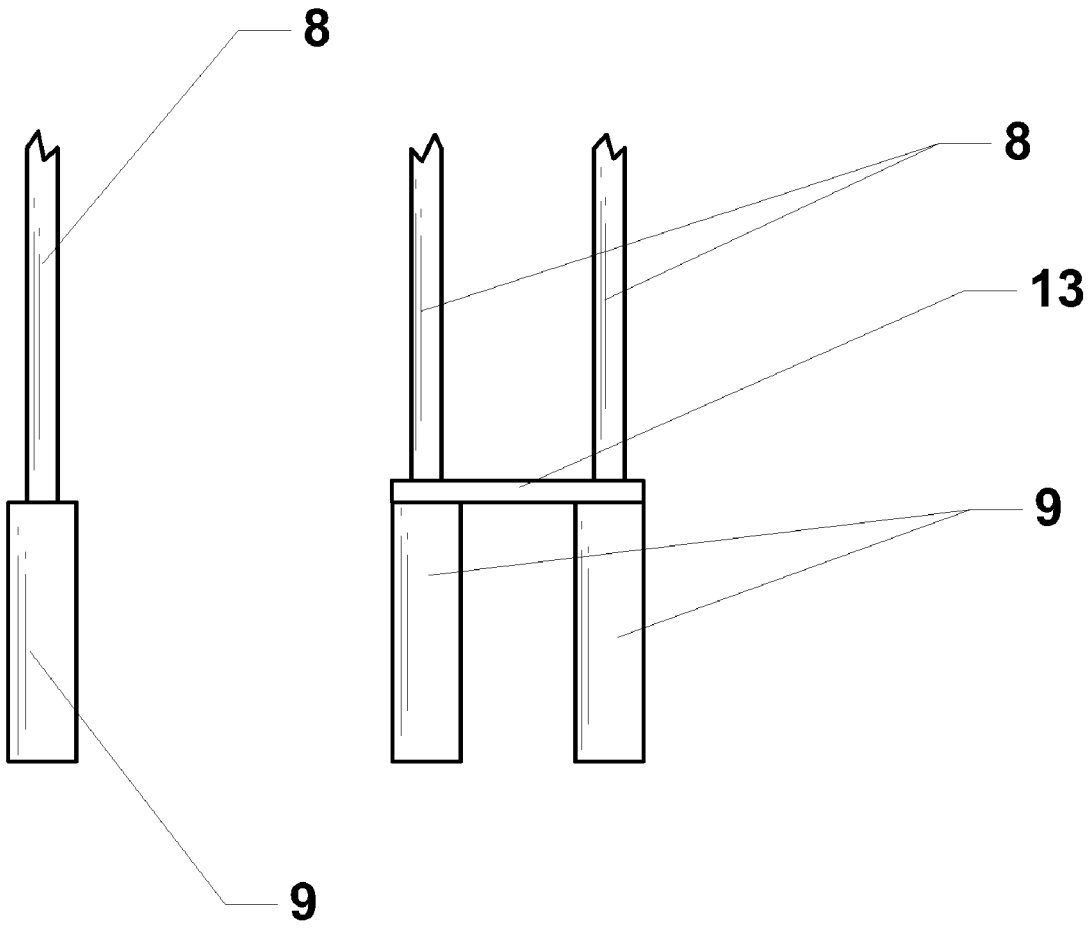
FIG. 3 is a close up view of portions of the embodiments of FIGS. 1 and 2 side-by-side.

Referring also to FIG. 3, the flexible support 1 may be a single or double flexible fiberglass rod(s) 8, and the flexion point may be a flexible material or spring, which is illustrated schematically as spring(s) 9. In the case of a paired or double support, it is preferred to include a brace 13 to help keep the two supports of the pair together as a unit.

Then, a padded target 3 is attached lengthwise over an opposite end of the elongated flexible support. The padded target 3 comprises a rubber/foam/vinyl oval-shaped target. It is preferred, but not required, for the padded target to be configured (shaped and/or sized) to represent an opponent of the individual being trained. Thus, as illustrated in FIG. 1, a cylindrical shape is suitable, or as illustrated in FIG. 2 a wider rectangular shape may also be used.

The second component is a base 4, which lies on the ground and thus is typically a heavy metal or other heavy material so that base 4 will not move except when intentionally moved.

Figure 7:
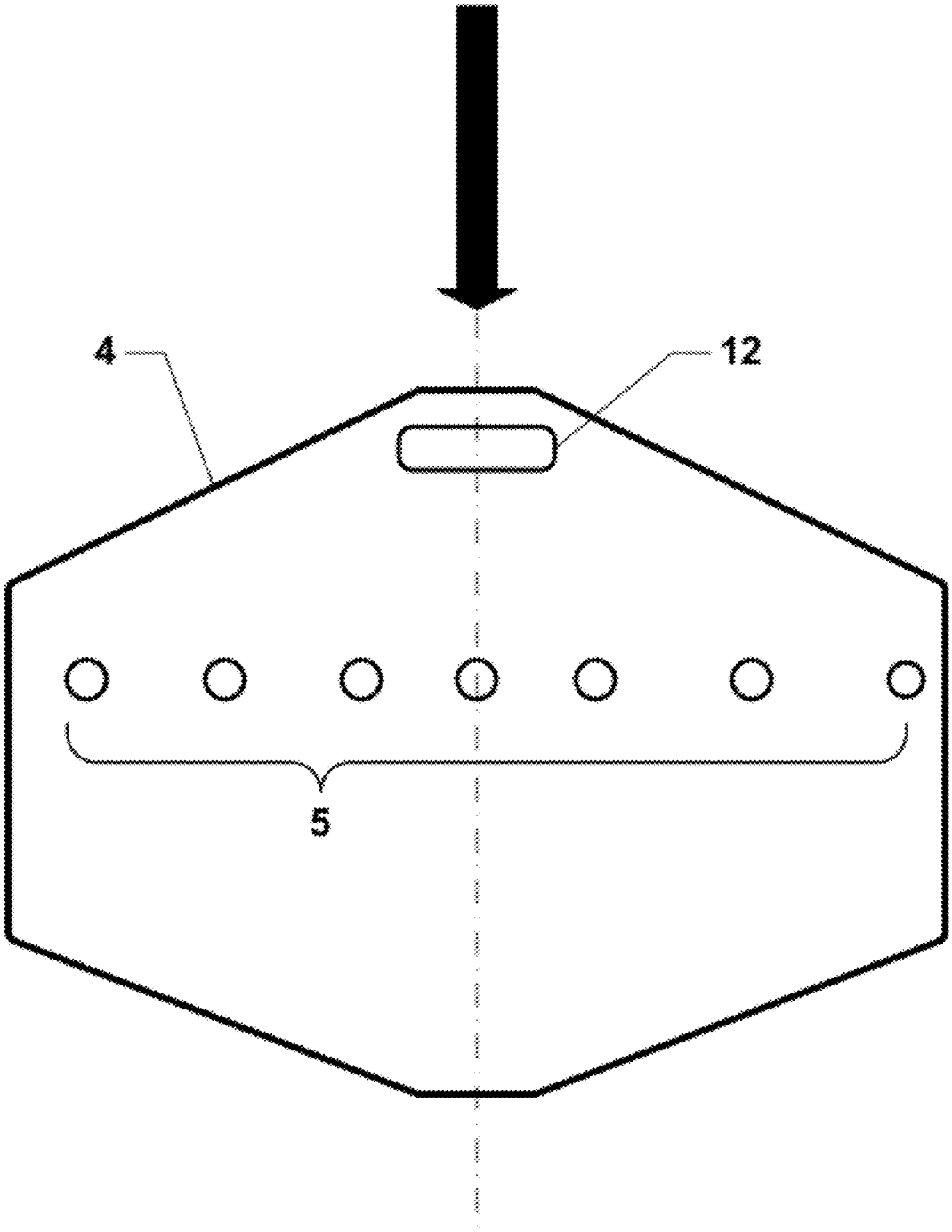
FIG. 7 is a top view of one embodiment of the base component of the training system.
Figure 8:
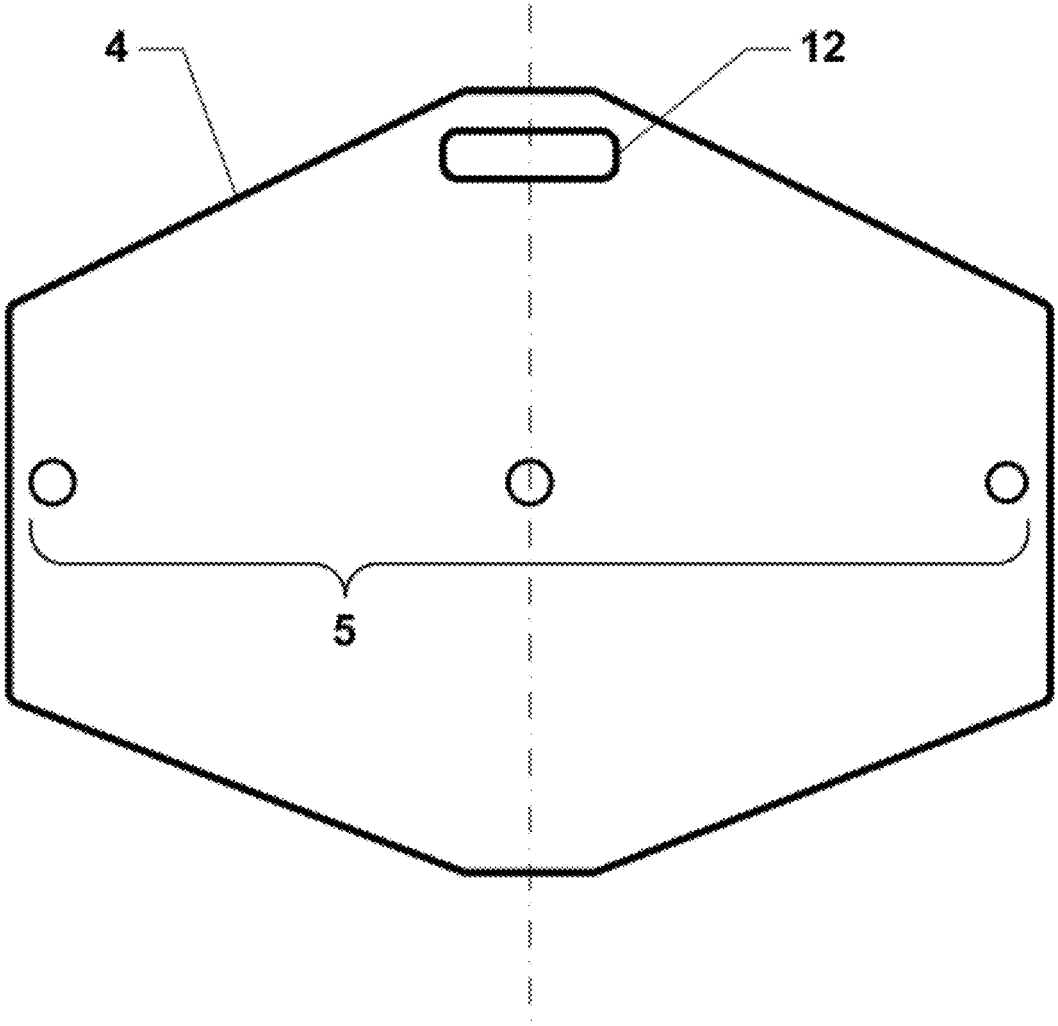
FIG. 8 is a top view of another embodiment of the base component of the training system.

Referring also to FIGS. 7 and 8, the base 4 comprises several receptacles 5. In the preferred embodiment, a receptacle 5 is a hole or similar recess below the surface of the base 4. In less preferred embodiments not illustrated here, a receptacle could be an elevated mount or other type of attachment. Each receptacle 5 vertically holds one elongated flexible support 1, yet allows for rapid repositioning of the flexible support 1 to any other of the three receptacles 5. Thus, without moving base 4 from its position, the target may be easily moved between each of the receptacles 5, i.e., it may be located at any of several positions. The base 4 is preferably a metal foundation 10 covered with a rubber/plastic material 11. It preferably has an optional handle 12. The preferred shape of the base is (as illustrated) an irregular octagon, but other shapes are possible provided they are stable enough for proper operation.

For best results, each base 4 has at least three receptacles 5 (for example, FIG. 8), or more preferably six arranged in pairs, as shown in FIG. 7; FIG. 7 also includes a seventh receptacle along the centerline of base 5, which provides the most preferred configuration, as described below.

Figure 4:
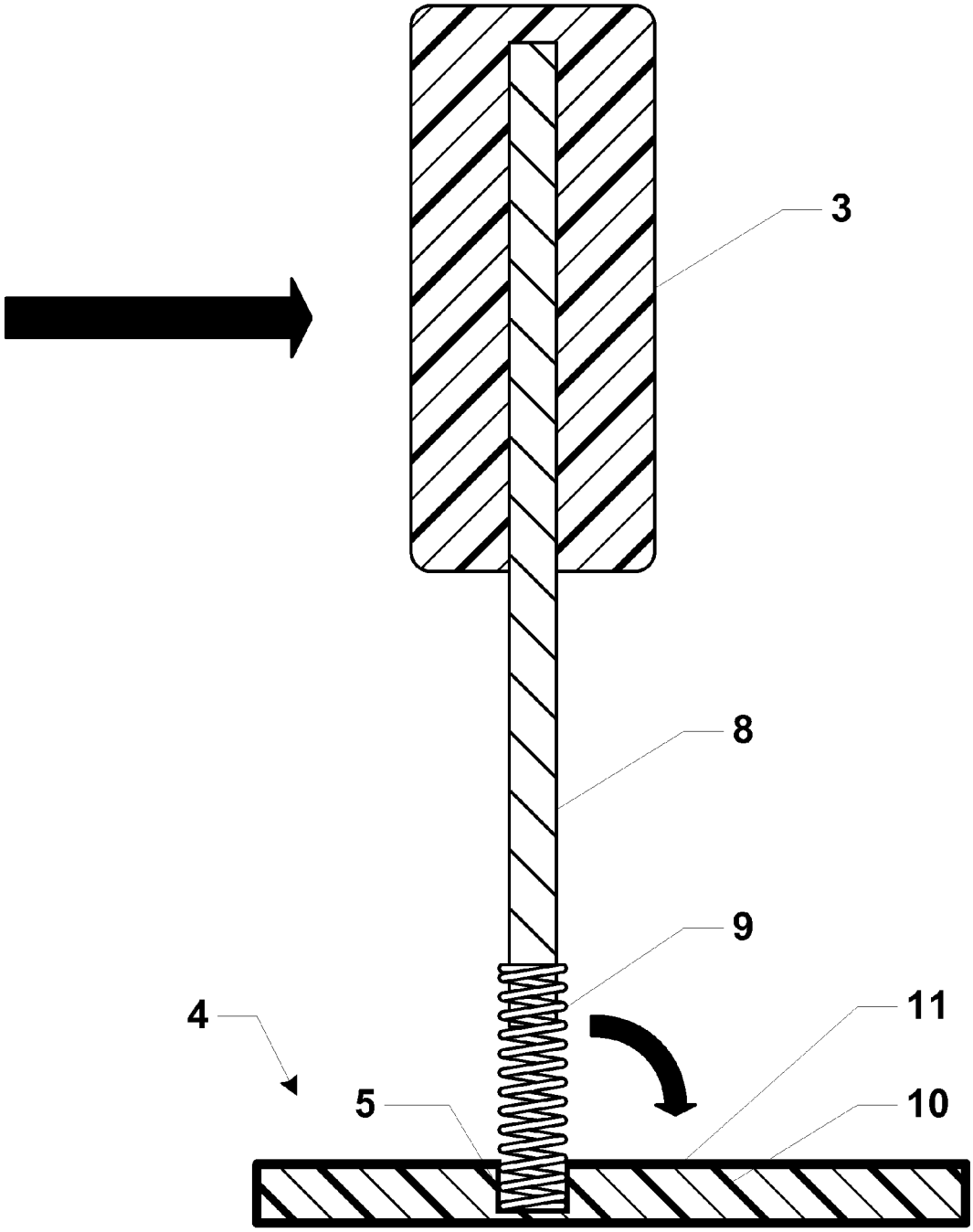
FIG. 4 is a side cross-sectional view of the embodiment of FIG. 1, illustrating details of construction and operation from a functional point of view.
Figure 5:
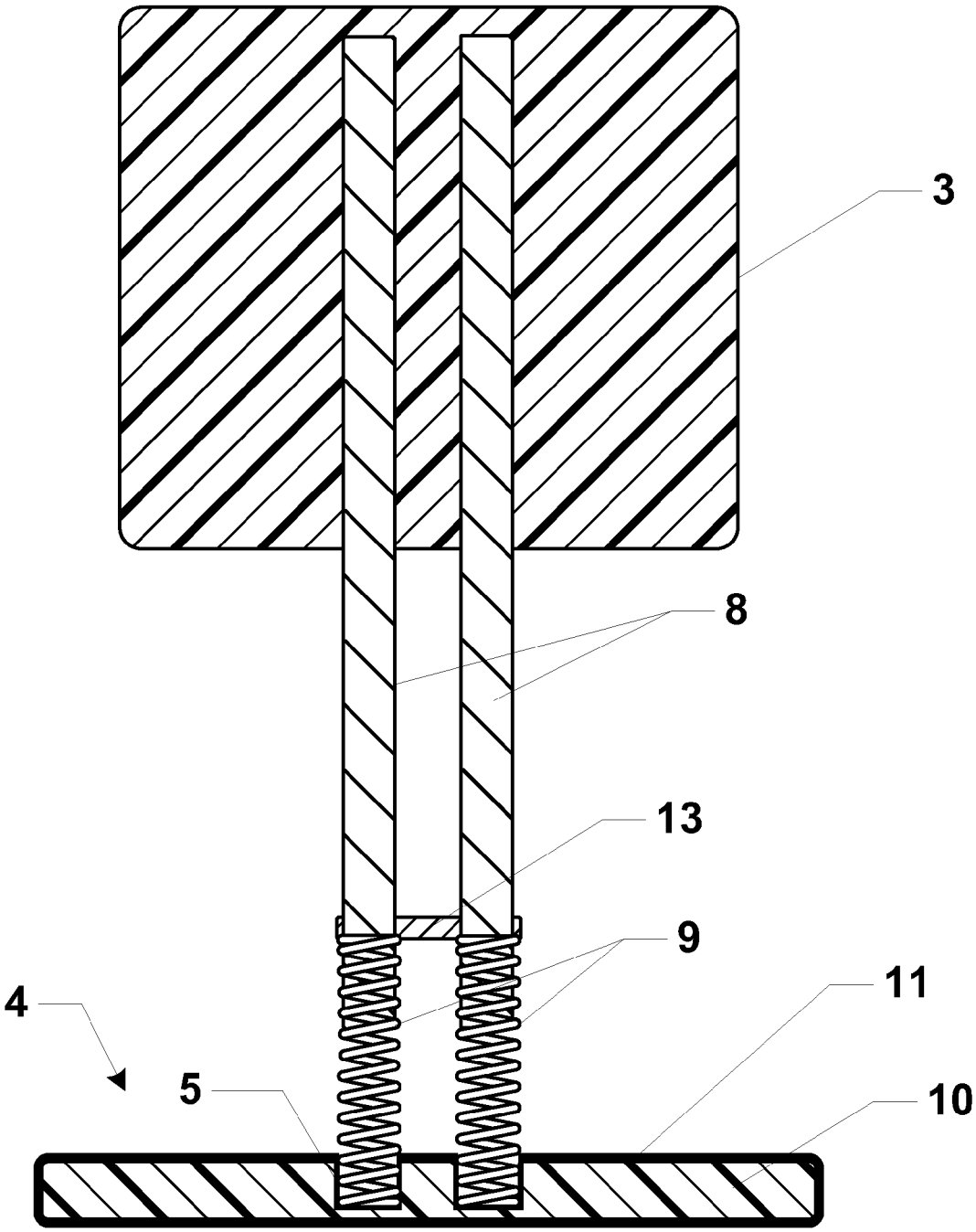
FIG. 5 is a front cross-sectional view of the embodiment of FIG. 2, illustrating details of construction and operation from a functional point of view.

Three receptacles provide three positions (left, center, and right) for the single-support version of the target shown in FIGS. 1 and 4. Six receptacles (three pairs of two receptacles) provide three positions (again, left, center, and right) for the double-support version of the target shown in FIGS. 2 and 5, and also has the advantage of providing six positions for the single-support version of the target. If the spacing of the six receptacles is even across the entire base, there are actually five separate positions for the double-support version of the target: first and second receptacles; second and third receptacles; third and fourth receptacles, fourth and fifth receptacles, and fifth and sixth receptacles.

Finally, the advantage of the seventh (center) receptacle is that it provides for a "universal base" that may accommodate both the single-support and paired-support versions of the target in each of the left, center, and right positions.

Figure 6:
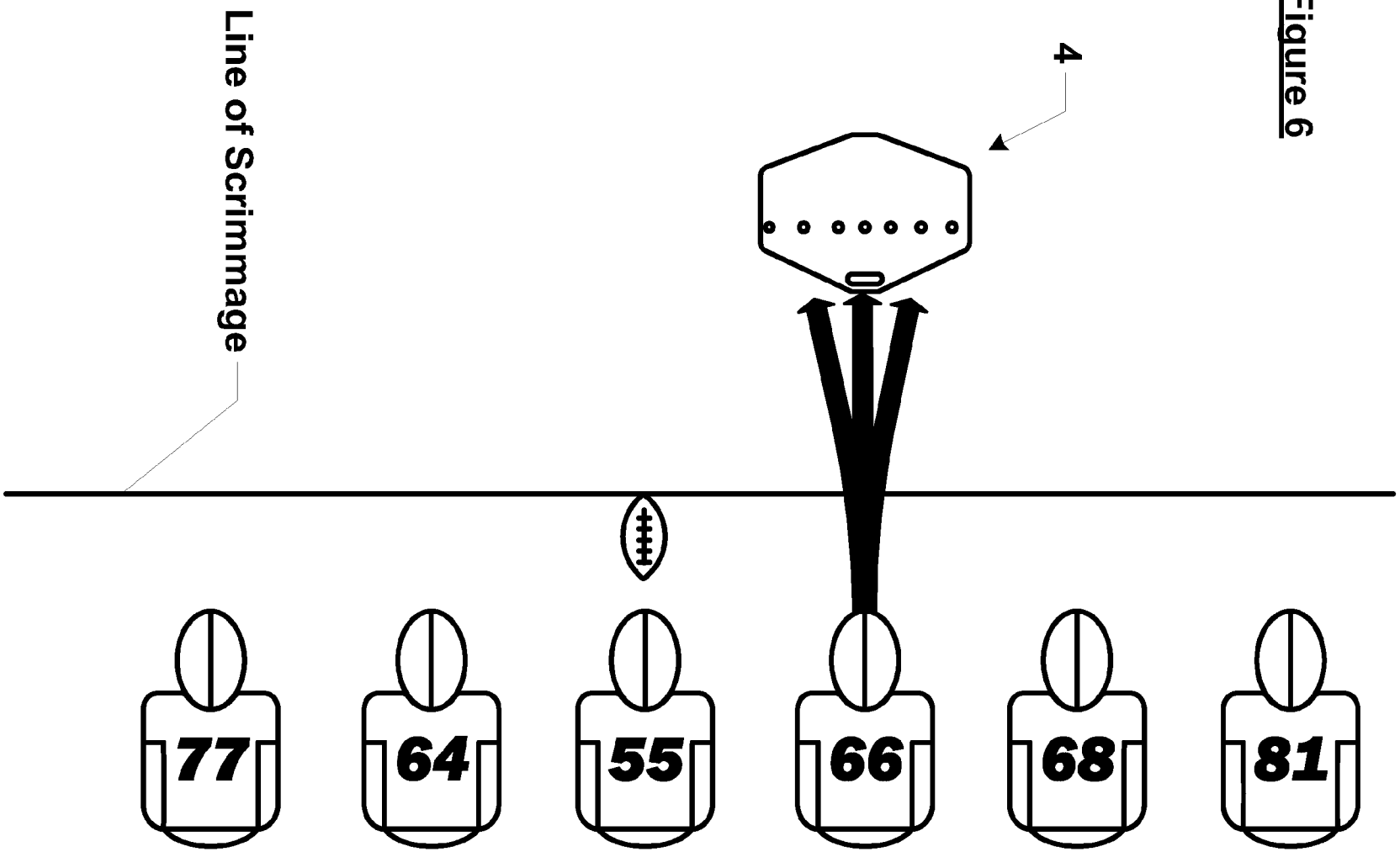
FIG. 6 is a top view of a training situation for American football, in which six offensive players face the line of scrimmage. One of the base components of the training system described in this application is lined up on the defensive side of the line of scrimmage, in a position generally corresponding to a defensive linemen who is not illustrated. Other portions of the training system have been removed for clarity only.

The receptacles should be located generally near the centerlines of the base, but it is possible to move them slightly ahead of the side-side centerline so that more of the base is behind them to reduce tipping of the base when the player strikes the target while moving in the directions indicated by the arrows in FIGS. 4, 6 and 7.

The training system comprises one or more such units in combination with each other and used to train one or more players. The target unit functions as a representative of an opponent and their position relative to the individual player (s). The grouping of individual units that work together creates a system that allows for the quick and easy movement of the target unit. By positioning and repositioning the target unit on the base, a coach or other trainer can within seconds create new formations/fronts/techniques/assignments for one or more players. The result is an adaptable, structured arrangement particularly for the instruction/training of players of American football. It is suitable for all organized football teams from youth to professional.

Features

Many prior dummies employed substantially heavy springs to provide a substantial amount of force to resist the motion of the player, i.e., to simulate the actual force of game impact on the player. However, the training system described here operates on the principle that effective learning of football assignments and techniques comes from rapid repetition against the light resistance of the target, allowing the focus of the athlete to be on their assignment and technique, not the strength of the hit. The flexibility of the target unit about the flexion point allows a player to safely attack the target unit with proper technique/fundamentals and footwork at speeds from "walk through" to "run through" or full speed. Similarly, because of the relatively light resistance, athletes may practice at full speed for extended periods of time without fatigue. Over the long run, this improves the aggression level of the athlete by increasing their confidence in their mastery of the assignment or technique.

Thus, the strength of the spring used in the training system described here is relatively weak compared to those in prior use. This permits the target to return to its position within seconds to be ready for another repetition of the play. In practice, a range of suitable spring strengths is easily found by considering the weight of the remainder of the target and balancing the need for the target to return upright within a few seconds at most with the need for the spring to be strong enough to hold the target upright prior to a hit without the target leaning away from vertical. The result is an increase in the number of repetitions in a given amount of time of from two to four times.

The upright may be on the order of one-half to one inch in diameter, and may be hollow or solid as desired. The target is preferably a resilient material such as polymer foam. It is preferably covered in heavy duty waterproof material such as vinyl, which may be attached in any convenient manner. The top height of the target is typically in the range of three to six feet but can vary depending on the age and training needs of the players.

The relatively low (on the order of one inch) height of the base allows it to be easily run over by a player without tripping over it. It is preferred, but not required, for the base to have beveled edges to avoid catching the cleat or toe of a player's shoe.

The base should be relatively wide, on the order of two to four feet in each direction, so that it presents a stable platform that will not tip over even if the target is bent to ninety degrees.

It is preferred, but not required, that the base be covered with a resilient, non-marking material (e.g. rubber or similar synthetic material) so that the base may be used on natural grass or artificial turf, and either outdoors or indoors (e.g., gymnasium or training room floor).

Advantages

Because a single base may support multiple locations (each such location being a single or pair of receptacles), a variety of combinations of base placement and target placement on the base are easily provided without substantial effort. This allows the training system to quickly represent virtually any offensive or defensive front or alignment. Thus, for example, the training system enables an offensive player to practice against a variety of different "looks" that their counterpart defensive player may assume. In an actual game, on any given play, the defensive player may line up directly ahead of the offensive player, or "shade" the offensive player by lining up slightly to either side, i.e. "inside" or "outside" relative to the football. This is illustrated in FIG. 6, in which three possible defensive positions are indicated by the three arrows representing the direction that the offensive right guard number 66 must go after the ball is snapped (the remainder of the defensive positions are not shown for clarity). As is well known, offensive players may not move prior to the snap of the ball, which means that such players must learn how to block against a variety of such "shades" for each formation. This requires learning correct footwork, hip and pad level, aim point and head placement, body leverage, and other considerations for safe and effective blocking.

For both offensive and defensive players, another advantage provided by the training system is that players may practice without human players on the opposite side of the line. This provides improved learning, both offensively and defensively, because all athletes can be on one side of the ball during the initial learning phase of a new play (or a practice as a whole). This is particularly valuable when teams have relatively fewer numbers of players and thus it is likely that players play both offensive and defensive plays in an actual game. That is, if offensive players learning a new play must line up against other offensive players "standing-in" as a scouted defense for an upcoming opponent, those playing that defense (which is not the focus of the training) must concentrate on accurately simulating a defense—and typically not the same type of defense that they will play themselves—instead of learning the offensive play. The training system described here allows all players to stand on the same side of the line of scrimmage and concentrate on observing, learning, and participating in the play they need to learn, not that of some other team. None of them need to serve as a "human dummy," which may involve a mismatch of physical size or talent that can lead to injury and other problems.

A similar advantage is that when it is desired to teach a play or technique that focuses on the position or motion of a single opposing player (e.g., how the offensive line should react to a defensive linebacker who joins the defensive line or blitzes), the training system may be used to represent the remainder of the opposing players (thus, only the player of interest is an actual player) without needing personnel to stand in for less important players in the opposing formation.

Reduction of physical contact between players, during portions of practice that do not require contact but instead are directed toward learning blocking and other assignments, reduces the likelihood of injury.

Unless specifically indicated otherwise, references to offensive formations, players, and the like should be understood as applicable to their defensive counterparts, and vice versa.

We claim:

1. A football training system, comprising, in combination:

a) an elongated flexible support capable of bending substantially ninety degrees in any direction about a flexion point located adjacent a lower end of the flexible support;

b) a padded target attached lengthwise over an upper end of the elongated flexible support;

c) a base comprising three receptacles, each for vertically holding the elongated flexible support above the base, yet allowing for rapid repositioning of the flexible support to another of the three receptacles; each of the three receptacles being located at one of left, center, and right positions relative to a centerline of the base.

2. The football training system of claim 1, in which the base further comprises a handle.

3. The football training system of claim 1, in which the base has six edges forming an irregular octagon.

4. The football training system of claim 1, in which the base is formed substantially entirely from a resilient material.

5. The football training system of claim 1, in which the base comprises an inner material externally covered with a resilient material.

6. The football training system of claim 1, in which the elongated flexible support is a pair of substantially identical support shafts arranged parallel to each other.

7. The football training system of claim 1, in which each of the three receptacles of the base is a pair of substantially identical receptacles, the base thus providing a total of six receptacles, each receptacle holding one support shaft of a double-shafted support, the base providing a total of five distinct pairs of immediately adjacent receptacles among the total of six receptacles.

8. The football training system of claim 7, in which the base further comprises a seventh receptacle centered between the centermost pair of immediately adjacent receptacles.

9. The football training system of claim 1, in which the padded target is essentially rectangular.

10. The football training system of claim 1, in which the padded target is essentially cylindrical in cross-section and centered on a vertical axis of the elongated flexible support.

11. The football training system of claim 1, in which at least one receptacle is a vertically opening recess below the surface of the base.

12. A method of training football players, comprising:

a) providing an elongated flexible support capable of bending substantially ninety degrees in any direction about a flexion point located adjacent a lower end of the flexible support;

a padded target attached lengthwise over an upper end of the elongated flexible support;

and a base comprising three vertically opening receptacles, each for vertically holding the elongated flexible support above the base, each of the three receptacles being located at one of left, center, and right positions relative to a centerline of the base; and b) positioning the flexible support above the base so the padded target represents an opposing football player during training.

13. The method of training football players of claim 12, further comprising providing each of the three receptacles of the base as a pair of substantially identical receptacles for holding one support shaft of a double-shafted support, the base thus providing a total of six receptacles, such that the base provides a total of five distinct pairs of immediately adjacent receptacles among the total of six receptacles.

14. The method of training football players of claim 13, further comprising providing the base with a seventh receptacle centered between the centermost pair of immediately adjacent receptacles.

15. The method of training football players of claim 12, in which at least one receptacle is a vertically opening recess below the surface of the base.

* * * * *